US008545930B2

(12) United States Patent
Stavlid

(10) Patent No.: US 8,545,930 B2
(45) Date of Patent: Oct. 1, 2013

(54) MANUFACTURING OF LOW-FRICTION ELEMENTS

(75) Inventor: Nils Stavlid, Uppsala (SE)

(73) Assignee: Applied Nano Surfaces Sweden AB, Stockholm (SE)

( * ) Notice: Subject to any disclaimer, the term of this patent is extended or adjusted under 35 U.S.C. 154(b) by 461 days.

(21) Appl. No.: 12/746,215

(22) PCT Filed: Dec. 5, 2008

(86) PCT No.: PCT/EP2008/066909

§ 371 (c)(1),
(2), (4) Date: Jun. 4, 2010

(87) PCT Pub. No.: WO2009/071674

PCT Pub. Date: Jun. 11, 2009

(65) Prior Publication Data

US 2010/0272931 A1 Oct. 28, 2010

(30) Foreign Application Priority Data

Dec. 7, 2007 (SE) ..... 0702751

(51) Int. Cl.
*C23C 26/00* (2006.01)

(52) U.S. Cl.
USPC ..... 427/11

(58) Field of Classification Search
USPC ..... 427/11
See application file for complete search history.

(56) References Cited

U.S. PATENT DOCUMENTS

| | | | | |
|---|---|---|---|---|
| 2002/0183209 | A1 | 12/2002 | Jee et al. | |
| 2005/0182494 | A1* | 8/2005 | Schmid | 623/23.5 |
| 2007/0231564 | A1 | 10/2007 | Ochi et al. | |

FOREIGN PATENT DOCUMENTS

| | | | |
|---|---|---|---|
| CN | 1142320 | C | 3/2004 |
| GB | 847800 | | 9/1960 |
| JP | 2004-76914 | A | 3/2004 |
| WO | WO 95/02023 | A1 | 1/1995 |

OTHER PUBLICATIONS

Podgornik et al. "Combination of DLC coatings and EP additives for improved tribological behaviour of boundary lubricated surfaces" Jul. 2006, Wear, vol. 261, No. 1, pp. 32-40.*

B. Podgornik et al. "Combination of DLC coatings and EP additives for improved tribological behaviour of boundary lubricated surfaces", Wear 261, 2006, pp. 32-40.

B. Podgornik et al. "Influence of contact conditions on tribological behaviour of DLC coatings", Surface & Coatings Technology 202, 2007, pp. 1062-1066. Nils Stavlid, "On the Formation of Low-Friction Tribofilms in Me-DLC—Steel Sliding Contacts", Uppsala University 2006, ISBN 91-554-6743-1.

* cited by examiner

*Primary Examiner* — Kelly M Gambetta
(74) *Attorney, Agent, or Firm* — Birch, Stewart, Kolasch & Birch, LLP

(57) ABSTRACT

A manufacturing method of mechanical elements comprises providing (210) of a mechanical element having a rough curved surface preferably with a surface roughness of more than $S_a$=0.1 μm. The method is characterized by tribochemically depositing (214) solid lubricant substance directly onto the rough curved surface in transverse directions. A mechanical element has a curved surface. The curved surface has a surface layer of a tribochemically deposited solid lubricant substance. The mechanical element is obtainable by the above method. A tool for manufacturing of such a mechanical element comprises a support portion, at least one tool working surface, means for providing a force pressing the tool towards the curved surface and driving means for moving said at least one tool working surface in two different directions along said curved surface. The working surface comprises an oxide, carbide and/or suicide of an element capable of forming a stable sulfide.

12 Claims, 7 Drawing Sheets

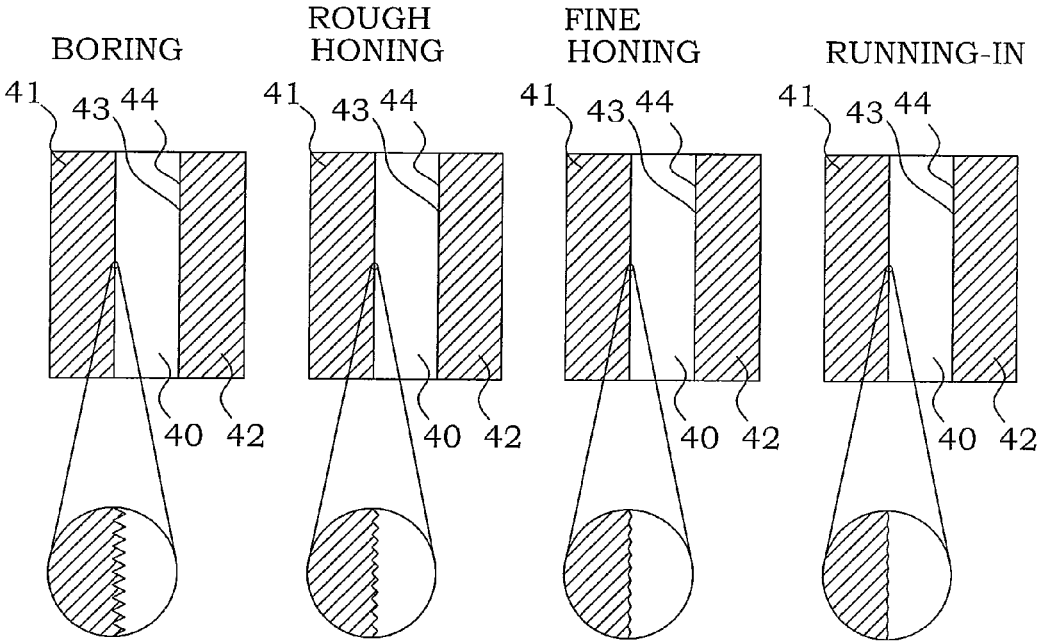
PRIOR ART Fig. 2
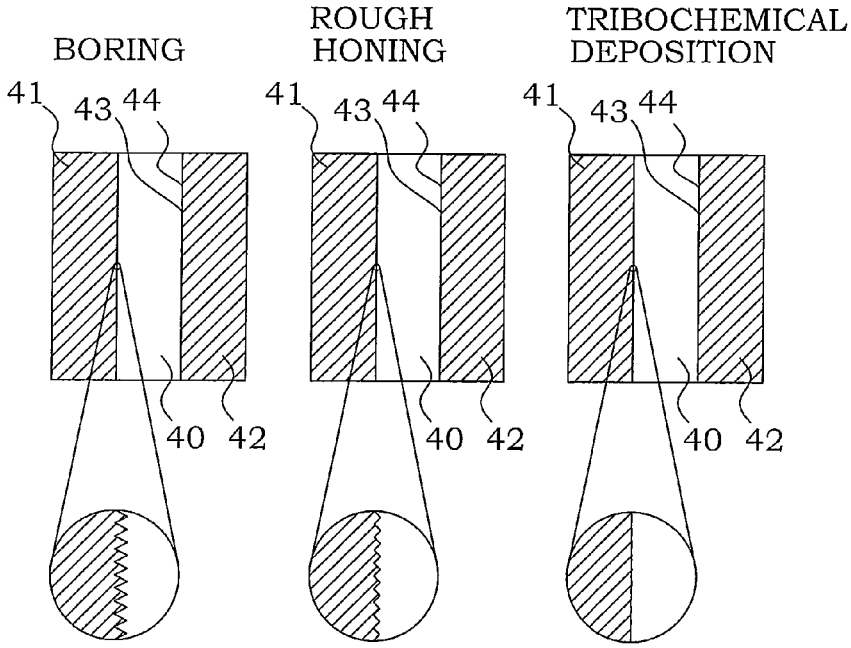
Fig. 3

MANUFACTURING OF LOW-FRICTION ELEMENTS

TECHNICAL FIELD

The present invention relates in general to manufacturing of low-friction elements, tools therefore and elements made thereby.

BACKGROUND

In internal-combustion engines, it is commonly used to let the combustion process take place within a cylinder whereby a piston is forced to move relative the cylinder. The relative movement has to experience a low friction in order not to waste the energy released by the combustion process and particularly not to transfer the released energy into heat in the piston and cylinder. Furthermore, the physical relation between the piston and the cylinder has to be such that any leaks of combustion gases are reduced to a minimum.

To this end, the inner surface of the cylinder is carefully treated, in order to reach a final surface roughness typically in the range of $S_a$=0.15-0.50 μm. Such a surface treatment process is normally performed in a number of steps; boring, rough honing, fine honing, plateau honing and possibly running-in of the cylinder against the mating piston ring. The resulting surface profile often consists of a plateau shape stylus with flat summits and valleys available for containing lubricant, i.e. lubricant reservoirs.

During operation of the piston and cylinder, a lubricant is usually added. The remaining roughness in the cylinder walls can contain small volumes of lubricants, which provides a film between the cylinder and the piston, giving rise to relatively low friction coefficients, i.e. full film lubrication. However, as the sliding speed approaches zero at the turning points of the piston the requirements for full film lubrication is not fulfilled. In this regime, called boundary lubrication, the friction coefficient is determined by the shearing properties of the two solids in contact; piston ring material and cylinder wall material.

The traditional lubricant is based on a petroleum product. When coming into contact with the hot environment in the cylinder, some of the lubricant will also decompose. Since the lubricants often comprise not so very environmentally friendly elements, such decomposing of the lubricants can give rise to hazardous combustion gases. There is therefore a need for reducing such addition of hazardous lubricants for environmental reasons. Maintaining good lubricity between the piston ring and cylinder will though be difficult without such lubricant additives.

Alternative lubricating substances, such as solid lubricants, have also been used. Graphite, $MoS_2$ and $WS_2$ are e.g. known to exhibit low friction properties. In WO95/02023 a cylinder bore wall of an engine is provided with a thermally sprayable powder comprising a core of at least graphite and $MoS_2$ encapsulated in a thin metal shell of a soft metal such as e.g. Ni or Sn. The coating also provides a porosity in which oil lubricants may be retained. In the English translation of the abstract of CN1332270, a method is disclosed in which low friction surfaces are provided by electroplating or chemical plating in plating liquids containing $MoS_2$ or $WS_2$. In GB 847,800, metal sulfide coatings are provided by thermal decomposing of polymers containing e.g. W and S.

Curved surfaces, and in particular inner cylinder walls, present a particular challenge for surface treatment. Surface coatings based on spraying, electroplating, thermal decomposing, PVD, CVD etc. are difficult to provide in a smooth, even and controllable manner over the entire surface. The reason is mainly geometrical, since equipment or substance supplies have to be performed in the typically restricted volume inside the cylinder and also subject to possible shadowing effects. Entirely new manufacturing process steps and manufacturing tools have to be provided, which makes the production costs very high.

Furthermore, the solid lubricant layers provided by prior art methods have different kinds of inherent drawbacks. In cases powders in soft metal shells are utilized, the lubricant properties of the core are partly prohibited by the soft metal. Furthermore, the lubricant substance of the core is provided in an arbitrary crystal direction thereby presenting both low friction surfaces and surfaces with somewhat higher friction. In the case of electroplating or thermal decomposing, the adhesion of the surface layer to the cylinder wall is difficult to control, as well as any crystal growth direction. Furthermore, adapted reaction environments have to be provided.

SUMMARY

An object of the present invention is to provide a method for improved manufacturing of elements having a low friction surface. A further object of the present invention is to provide such methods that are easy and non-expensive to perform. It is also an object of the present invention to provide elements having low-friction surfaces according to such manufacturing method and manufacturing tools for carrying out such manufacturing method.

The above objects are achieved by methods, devices and arrangements according to the enclosed patent claims. In general words, in a first aspect, a manufacturing method of mechanical elements comprises providing of a mechanical element having a surface to be covered. Preferably, a surface roughness is higher than $S_a$=0.1 μm, where $S_a$ is defined as the three-dimensional arithmetic average roughness, also known as the centre-line average roughness. The method is characterized by tribochemically depositing solid lubricant substance directly onto the surface to be covered. The tribochemical depositing is performed in each point of at least a part of the surface to be covered in at least two transverse directions along said surface to be covered.

In a second aspect, a mechanical element has a low-friction surface with a surface layer of a tribochemically deposited solid lubricant substance, deposited in each point of at least a part of the surface in at least two transverse directions along the surface.

In a third aspect, a manufacturing tool for surface treatment of mechanical elements comprises a support portion, at least one tool working surface, means for providing a force pressing the tool working surface towards a surface to be covered and driving means for moving the tool working surface in at least two transverse directions along the curved surface at each point of at least a part of the surface. The tool working surface is a tribochemical deposition tool working surface comprising an oxide, carbide and/or silicide comprising Mo and/or W.

One advantage of the present invention is that an extremely smooth element surface with a low friction coefficient is possible to achieve by even fewer surface treatment steps than normal prior art approaches. This is due to the fact that the tribochemical deposition acts simultaneously on the surface roughness parameters on two frontiers by reducing both surface peaks and bottom valleys in several directions. The tribochemical deposition in at least two transverse directions in each point ensures a uniform surface layer. A relatively thick surface layer with good adhesion properties to the cylinder main material is further provided when deposition is made on a relatively rough original surface. An inherent directionality of a tribochemical reaction process to the parallel to one of the sliding directions further ensures that the solid lubricant have low-friction crystal planes oriented in parallel to the surface and can be controllable to be directed in an intentional relative motion direction.

BRIEF DESCRIPTION OF THE DRAWINGS

The invention, together with further objects and advantages thereof, may best be understood by making reference to the following description taken together with the accompanying drawings, in which:

FIG. 2 is a schematic illustration of a prior art engine cylinder manufacturing process;

FIG. 3 is a schematic illustration of an embodiment of an engine cylinder manufacturing process according to the present invention;

DETAILED DESCRIPTION

Throughout the present disclosures, equal or directly corresponding features in different figures and embodiments will be denoted by the same reference numbers.

Figure 10A:
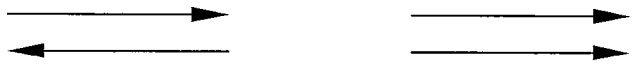
FIGS. 10A-B illustrates the meaning of transverse directions.
Figure 10B:
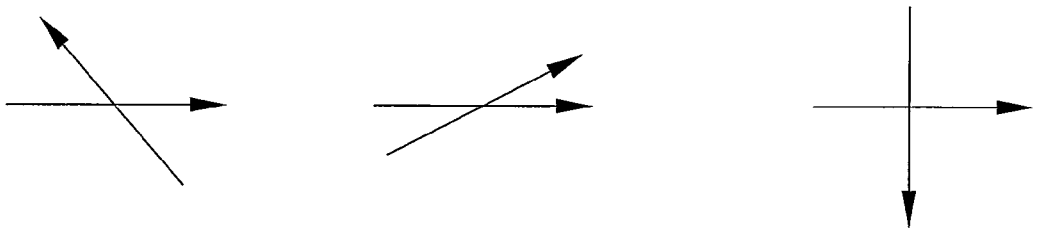

In the present disclosure, the term "transverse" is used. Throughout the present disclosure, the intended meaning of movement in two transverse directions at or along a surface is defined by two non-parallel movements that are intersecting in a point on the surface. FIG. 10A illustrates two examples of motion that are considered to be non-transverse motions. FIG. 10B instead illustrates three non-exclusive examples of transverse motions. In these examples, there is at least one point at the surface in question that is passed in two non-parallel directions.

According to the present invention, a surface is provided with a solid lubricant by means of tribochemical deposition directly onto a, preferably relatively rough, surface to be covered. Tribochemical deposition is as such well known in the field of friction and wear. Formation of compounds having a composition similar to $WS_2$ is e.g. observed in the comprehensive summary of the Ph.D. thesis of Nils Stavlid, "On the Formation of Low-Friction Tribofilms in Me-DLC-Steel Sliding Contacts", Uppsala University 2006, ISBN 91-554-6743-1.

Figure 1:
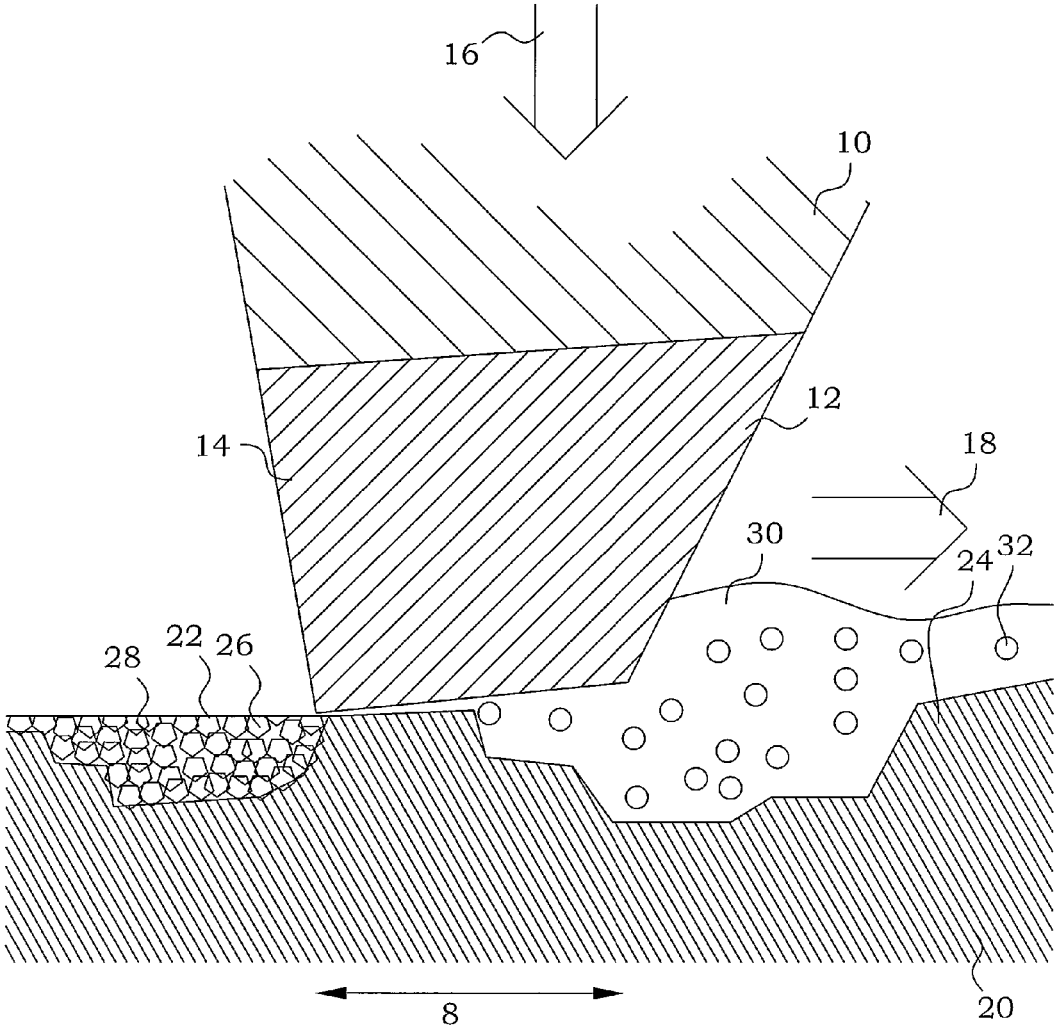
FIG. 1 is a schematic illustration of tribochemical deposition.

In FIG. 1, a model system is described. A working surface 12 of a tool 10 is provided with tungsten carbide 14. The tool 10 is pressed by a force 16 against a substrate surface 20 to be treated. At the same time, the tool 10 is moved with a velocity 18 over the substrate surface 20. In the contact between the working surface 12 and the substrate surface 20, a tribofilm 22 is created on the substrate surface 20. In other words a tribofilm 22 is formed by tribochemical deposition. Tribofilms are often also referred to as wear transfer films, reaction layers etc.

Having two surfaces in contact and in relative motion cause a rubbing effect on the surfaces. At the contact point, an extreme local stress and increased local temperature occurs, which facilitates different chemical reaction routes for formation of the tribofilm. When the two surfaces are of different composition, i.e. the contact is heterogeneous, the reaction paths are often difficult to predict. The resulting tribofilms may therefore sometimes obtain chemical compositions that are not easily obtainable by other processes.

In the model system of FIG. 1, the substrate surface 20 is an iron-containing surface, e.g. a steel surface, which means that iron atoms 24 or particles are present at the substrate surface 20. Furthermore, a process fluid 30 comprising sulfur 32 in a free form is provided at or in vicinity of a contact area 8. Possible chemical reactions may comprise elements from the working surface 12 of the tool, from the substrate surface 20 and/or from the process fluid 30. In the present model system, it has been verified that a tribofilm 22 is formed comprising substances being or being similar to $WS_2$ 26, i.e. a solid lubricant material. Additionally, the substrate surface material also contributes to the chemical reaction forming a second phase 28, comprising FeS-like substances, since Fe is capable of forming stable sulfides. The formed tribofilm 22 in the model system thus has the solid lubricant 26 dispersed into a composite material, where the second phase 28 stems from the substrate material. This second phase 28 acts as a binder for the solid lubricant 26 onto the substrate surface 20.

Even though WC typically is considered as a very hard material and would not be expected to be worn, it can be established that a $WS_2$-containing film is formed by tribochemical deposition by a selective transfer of W from the W-containing working surface 12 to the substrate surface 20 and further chemical reaction with sulfur from the process fluid 30. The pressing force 16 is thus sufficient to generate a deformation of the material that leads to a chemical reaction between the tungsten, the sulfur and the substrate surface. The tribofilm 22 comprises virtually no carbon despite a high carbon content in the working surface 12 as well as in the process fluid 30.

The formed tribofilm 22 fills up essentially all gaps and unevenness originally being present on the substrate surface 20. The $WS_2$ is typically bound to the substrate material by metal-sulfur bindings (as in iron sulfide, FeS). The obtained surface of the tribofilm 22 becomes very smooth indeed, and a roughness down to below 10 nm is believed to be possible to produce within a near future. The smoothening operates by two mechanisms. First, the protruding edges of the substrate surface are cut by the physical action of the tool. Secondly, the formed tribofilm 22 fills up remaining valleys. The uniformity and efficiency of forming such a tribofilm 22 is greatly improved if the deposition is performed in more than one transverse direction, since edges and valleys then are affected in complementary manners. Furthermore, the use of more than one transverse direction in the sliding contact leads to a reduced tendency for void formation at the interface, this in turn leads to a enhanced coating adhesion.

The thickness of the tribofilm 22 depends significantly on the original roughness of the substrate surface 20. A thicker tribofilm 22 can be achieved from a rough surface than from a smooth surface. Also, it has been concluded that the binding to the substrate is stronger for a tribofilm formed on a rough surface than a smooth surface. The final roughness of the formed tribofilm is, however, practically independent on the original substrate surface roughness.

In applications, where a solid lubricant is requested at a surface as a friction reducing agent in frictional contact mechanical operations, a relatively thick and strong surface coating is requested. Surprisingly, according to the findings in the present invention, such surfaces are more readily obtained directly on rather rough surfaces than on smoother surfaces. At the same time, the final roughness of the final surface coating did hardly differ at all when comparing samples having different original surface roughnesses. This means that tribochemical deposition of solid lubricants is not only possible on relatively rough surfaces, but is even preferred. It has thereby been found that in order to provide a good solid lubricant surface, the original mean surface roughness ($S_a$) should be larger than 0.1 μm, preferably larger than 0.5 μm, more preferably larger than 1 μm and even more preferably larger than 2 μm.

Mean surface roughness may be defined in different manners. However, in the present disclosure, numerical values of surface roughness are defined by the 3-dimensional obtained $S_a$ value being the arithmetic average roughness, also known as the centre-line average roughness.

This surprising feature of the tribochemical deposition can advantageously be utilized in producing low-friction surfaces at different mechanical elements. The approach is particularly useful in preparing curved low-friction surfaces due to inherent problems with other alternative manufacturing processes being incompatible with curved surfaces. However, manufacturing of plane surfaces is also possible. The largest advantages are believed to appear when the curved surfaces are inner surfaces, e.g. an inner surface of a bearing bushing or the inner wall of a cylinder bore. Such bores can e.g. be cylinders of an internal combustion engine or cylinders of a hydraulic element. However, the present invention is also applicable on outer, convex, surfaces, such as e.g. shaft or piston surfaces. Rotationally symmetric surfaces are preferred since motions along rotationally symmetric surfaces are relatively easy to achieve.

In the following detailed description, a cylinder of an engine element is used as a model mechanical element.

In FIG. 2, a typical prior art manufacturing process of a cylinder of an internal combustion engine is schematically illustrated. A cylinder bore 40 is provided in a mechanical element 41, in this example an engine element 42. A curved surface 43, having a rotationally symmetric geometry, in this example an inner surface 44 of the cylinder bore 40 typically has a rough surface. A rough honing is performed using e.g. a diamond stone, which provides the cylinder bore 40 with exactly the right dimensions. At the same time, the inner surface is grinded to a finer surface roughness. The surface roughness is still too large for prior art applications, and a fine honing procedure is performed. A polishing stone is used to create a plateau finish. A diamond or a silicon carbide hone is typically used. The last step in this embodiment of a prior art process is to let the engine run to remove the last debris and smoothen the surface further. This part is often the most cumbersome since at least a part of the process typically takes place after e.g. the delivery of a vehicle. If the operation conditions are unfavourable, this running-in procedure may produce a cylinder bore surface far from ideal. The running-in step may also be omitted.

FIG. 3 illustrates a corresponding manufacturing process according to the present invention. The boring step is basically unchanged. The rough honing step may be present, but not totally necessary. If the boring is accurate enough to provide the cylinder bore with the exact final dimensions, even the rough honing may be omitted. The fine honing and running-in steps are also omitted. Instead, a step of tribochemical deposition is performed in at least two transverse directions. A solid lubricant layer is thereby formed directly on the rough surface, giving a surface of low friction as well as a very small roughness. A typical value of the surface roughness achieved by an industrial application of the tribochemical deposition is estimated to be in the order of less than 0.1 μm. For a robust film, the final surface roughness is preferably less than ⅔ of a surface roughness of an original substrate surface, i.e. the surface onto which the tribochemical deposition is performed. From a comparison between FIGS. 2 and 3, one immediately realizes that the present invention makes it possible to completely remove at least two steps in the manufacturing process and replace them with a single step that gives a low friction surface coating as well as a low surface roughness. This new step can furthermore be performed without too large modifications of traditional manufacturing equipment, which means that the present invention is fairly cheep to implement also in existing manufacturing lines.

In view of the above discussion, a cylinder of an internal combustion engine having surfaces according to the present invention experience a lower friction than a conventional cylinder. Tests have shown that 6% of the total energy supplied to an internal combustion engine typically is lost due to friction from the piston ring and cylinder lining contact. Other tests, performed on surfaces manufactured according to the present invention, show that boundary friction levels can be reduced by as much as 60%. Such a reduction will therefore allow a total efficiency improvement of 1.8 to 3%, reducing the fuel need. Estimations are made that during a lifetime of a cylinder, the savings in fuel may correspond to 5-10% of a total production cost of an entire vehicle.

Similar benefits will appear also when the manufacturing method is applied on other mechanical elements having curved surfaces that are requested to present a low friction.

Figure 4:
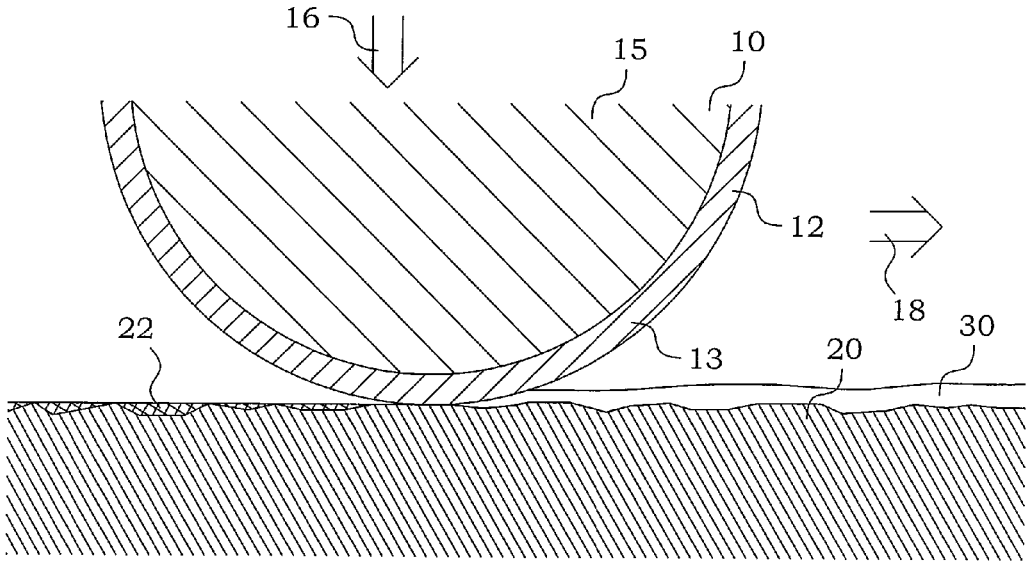
FIG. 4 is a schematic illustration of an embodiment of a tool according to the present invention interacting with a surface.

The tribochemical deposition operation as obtained by a tool according to the present invention interacting with a surface is schematically illustrated in FIG. 4. A tool 10 having a working surface 12, in this embodiment provided as a surface layer 13 provided around a circular tool core 15, is pressed 16 against and moved 18 relative a substrate surface 20. The substrate surface 20 before treatment has a surface roughness of at least 0.1 μm and preferably at least 0.5 μm. A process fluid 30 comprising sulfur is provided at the contact surroundings. A smooth tribofilm 22, comprising a solid lubricant, is resulting.

When using prior-art methods for covering a surface by e.g. $WS_2$-containing substances, the crystal planes of the solid lubricant will be directed essentially randomly. However, by forming tribofilms comprising solid lubricants, the actual tribochemical process introduces preferences in crystal plane directions. Luckily, the tribochemical process favours the solid lubricant crystal planes to be directed essentially parallel to the surface. This in turn means that e.g. easily sheared sulfur-sulfur planes in the $WS_2$ crystal are parallel to the surface, which gives a significantly reduced friction even compared with randomly oriented $WS_2$. A surface coated with $WS_2$ applied by tribochemical deposition therefore exhibits a lower friction than a surface coated with $WS_2$ applied in other ways.

The sliding contact in the tribochemical process causes wear of the substrate surface peaks. In other words, parts of the "peaks" of the rough surfaces will be eroded and assist in filling up the "valleys" together with material from the working surface. As mentioned further above, a more efficient treatment is obtained if this wear also is directed in more than one direction in each point of at least a part of a surface to be treated. The building of the film becomes more even and results in a denser surface layer with improved adhesion. In a general view, a motion of the tool along the substrate surface in at least two different directions that are transverse to each other, i.e. non-parallel to each other, is more efficient.

Empirical tests have been performed, comparing surfaces coated with $WS_2$ applied by tribochemical deposition in only one direction and surfaces coated with $WS_2$ applied by tribochemical deposition in transverse directions. The results show that surfaces coated in transverse directions present a smoother surface and a thicker layer of deposited $WS_2$. The friction coefficient is also generally lower at the surfaces coated in transverse directions. The lower friction is believed to be the result of the smoother surface as well as better tribofilm coverage.

The surface treatment in more than one direction also lowers the risk for transferring non-perfect geometries of the working surface to have any significant deteriorating impact on the final surface structure of the deposited film. For instance, if covering a circular cylinder surface, grooves texturing in the pure axial as well as in the pure tangential directions are only causing disadvantages. The same is true also for grooves having a pure spiral shape. However, by having the surfaces coated in transverse directions, any non-perfect geometries of the working surface will give rise to imperfections also distributed in transverse directions. Such patterns may assist in distributing e.g. additional fluid lubricants during the subsequent use.

However, the relative direction of movement between the substrate surface and the tool will also influence the crystal directions. The direction, in which the tool has been moved, in the case of a one-dimensional motion, will generally exhibit a somewhat lower friction coefficient than in a direction perpendicular thereto. In cases where the surface is known to be exposed for moving objects along substantially one direction, it is therefore preferred to have a major working direction of the tool in the same direction, while a minor working direction assists in improving the tribofilm quality. A shaft rotating within a bushing is known to have an essentially tangential relative motion. In such a case, it is preferable to have a majority of the working of the contact surfaces in a tangential direction, i.e. along the circumference of the shaft and/or bushing, and a smaller part transverse thereto. However, in a cylinder, a piston is intended to be moved essentially axially with respect to the cylinder. In such a case, the majority of the working of the contact surface is preferably performed in an axial direction, and a smaller part non-parallel thereto.

Figure 5:
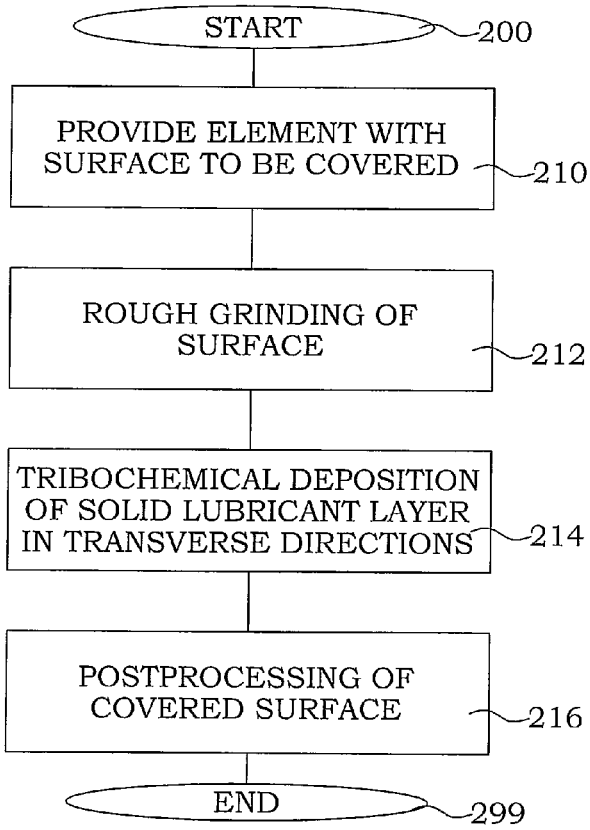
FIG. 5 is a flow diagram of steps of an embodiment of a manufacturing method according to the present invention.

FIG. 5 illustrates a flow diagram of steps of an embodiment of a manufacturing method according to the present invention. The manufacturing method begins in step 200. In step 210, a mechanical element is provided with a surface to be covered. The surface may be curved, preferably rotationally symmetric, e.g. a cylinder bore surface. In a typical case, such a cylinder bore can be an internal combustion engine cylinder bore, a turbine inner surface, a hydraulic cylinder bore or a sliding bearing cylinder surface. It may also be the outer surface of e.g. a shaft or a piston. In step 212, the surface to be covered is rough grinded, giving the surface the requested dimensions. A surface roughness of more than $S_a$=0.1 μm is to be preferred, and an even rougher surfaces up to at least the range of 2-3 μm are even more preferred due to the increased durability of the thicker coating. Step 212 may be omitted if e.g. step 210 directly provides the requested final dimensions and a suitable roughness. In step 214, a solid lubricant substance is tribochemically deposited directly onto the surface in at least two transverse directions. The tribochemical deposition is preferably provided by pressing and sliding a tribochemical deposition tool working surface against the surface, causing deformation in a contact zone between the tribochemical deposition tool working surface and the surface to be covered. This causes a wear transfer of material from the tribochemical deposition tool working surface to the surface to be covered, providing a smooth mechanical element surface, even far below 0.1 μm. In case of a cylinder, the sliding is preferably performed both in an axial and a circumferential direction of the cylinder bore. By using a suitable relationship between axial and circumferential movement of the tool one can ensure that the produced coating is dense and possesses a good adhesion as well as a low coefficient of friction, as discussed further above. Step 214 preferably also comprises supplying of sulfur to the contact zone during the pressing and sliding action, whereby the sulfur reacts with the material that is wear transferred to the cylinder. In step 216, any requested post-treatment of the covered surface, e.g. a cylinder bore, may be performed, such as surface texturing methods or heat treatments. In a basic version of the method, however, step 216 may be omitted. The procedure ends in step 299.

In the examples above, $WS_2$ has been used as a model solid lubricant as it comprises a layered crystal structure that is easily sheared. There are, however, also other candidates of solid lubricants to be used. Stable layered metal di-sulphides similar to $WS_2$ can be formed by metals as Ti, Nb, Mo and Sn. However, due to the missing possibility to form other sulphides with higher metal ratio, preferable W and Mo are of particular interest.

Figure 6:
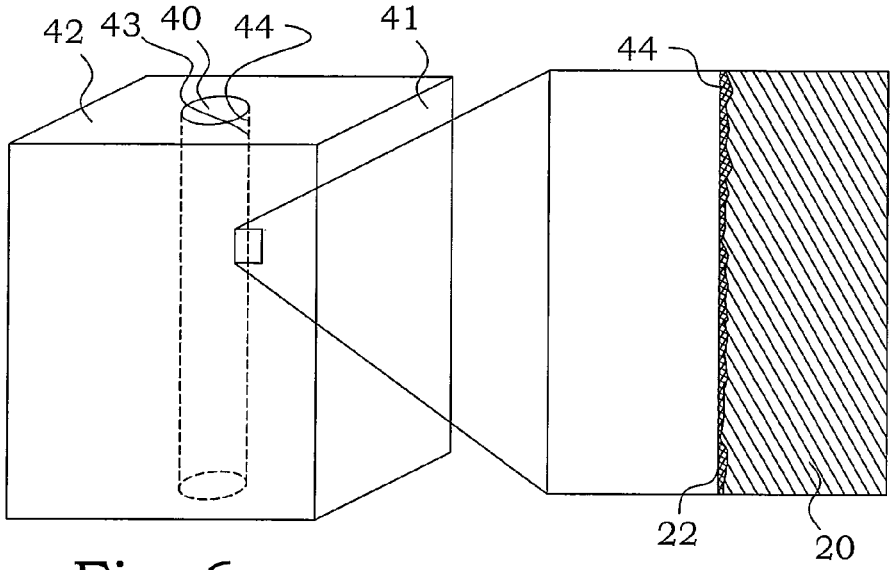
FIG. 6 is a schematic illustration of an embodiment of a mechanical element according to the present invention.

An embodiment of a mechanical element 41 manufactured by the method of FIG. 5 is schematically illustrated in FIG. 6. A structure, in this embodiment a cylinder bore 40 is provided in a mechanical element 41, in this embodiment an engine element 42, giving a curved surface 43, in this embodiment an inner surface 44. The engine element 42 has a layer 22 of a tribochemically deposited solid lubricant substance. Since the original surface roughness was more than 0.1 μm, the surface layer 22 thickness typically exceeds 0.1 μm and the final surface roughness becomes far below 0.1 μm.

Figure 7A:
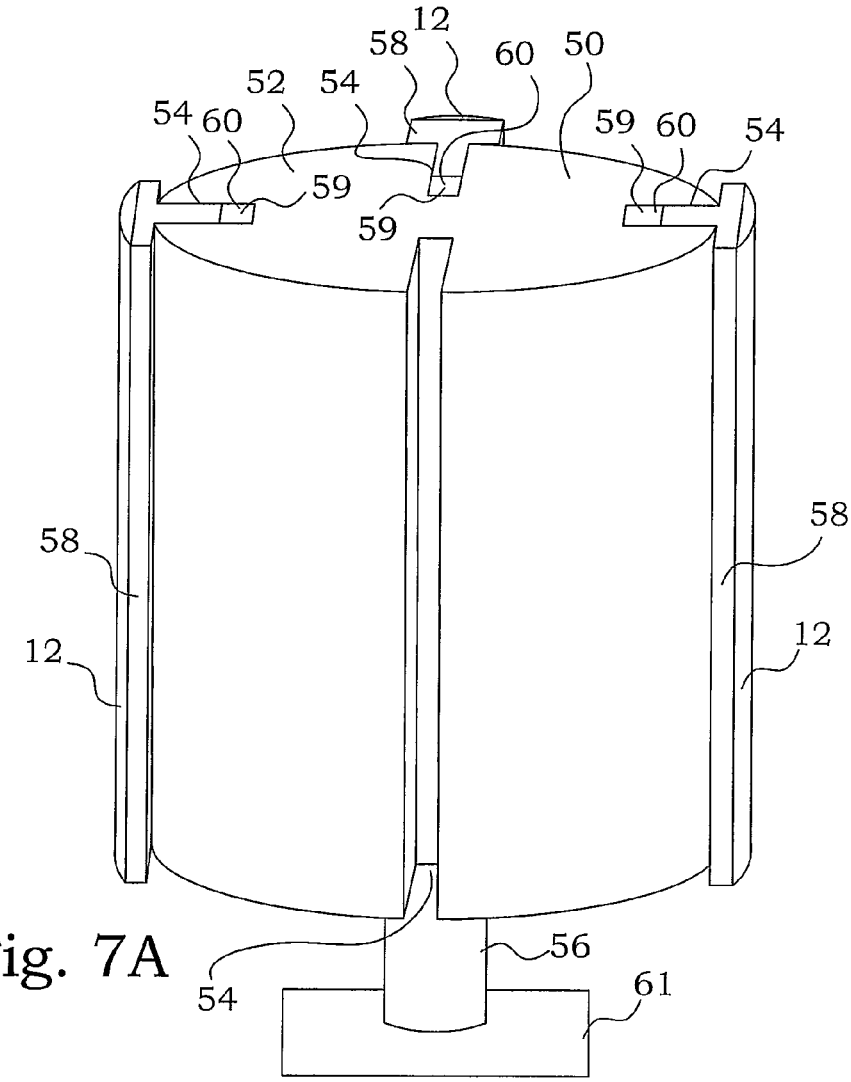
FIGS. 7A-B are illustrations of embodiments of tools according to the present invention.

An embodiment of a tool 10 for manufacturing of a mechanical element having a curved surface is illustrated in FIG. 7A. In this embodiment, the tool 10 is intended for processing of inner cylindrical surfaces. The tool 10 comprises a support portion 50, essentially formed by a cylindrical body 52 presenting a number of axially directed slits 54 distributed around the circumference of the cylindrical body 52. The cylindrical body is provided at a shaft 56. A tool holder 58, provided with a tool working surface 12, is arranged in each slit 54. (One tool holder is removed in the figure in order to increase the visibility of the front slit.) An elastic member 59 is provided in the slits 54 inside the tool holder. The elastic member 59 operates as a means 60 for providing a force pressing the tool working surface 12 outwards. Since the entire tool of this embodiment is intended to be put into a cylindrical hole for tribochemical deposition of the inside cylindrical surface, the tool working surface 12 is pressed towards that curved surface. The elastic member 59 could e.g. be a continuous beam of elastic material or an arrangement of springs. Alternatively, the means for providing a force pressing the tool working surface 12 towards the curved surface could be an active means, e.g. a mechanical arrangement that in a controlled manner provides a suitable pressing force, like compressed gases or hydraulic fluids.

The tool 10 further comprises a driving means 61, in this embodiment operating on the shaft 56. The driving means 61 is arranged for moving the tool working surfaces in two different directions along the curved surface. In this embodiment, intended for inside cylindrical surfaces, the driving means 61 rotates the shaft 56 and also translates it in an axial direction. For tools treating inside cylindrical surfaces, it is an advantage to have more than one working surface present. In the present embodiment, four working surfaces 12 are provided for. In the present embodiment, all four working surfaces 12 are intended to be working surfaces according to the description above. However, one or several of the working surfaces could be exchanged for purely mechanical working surfaces, only contributing with a general flattening operation, as complementary to the tribochemical working surfaces.

Figure 7B:
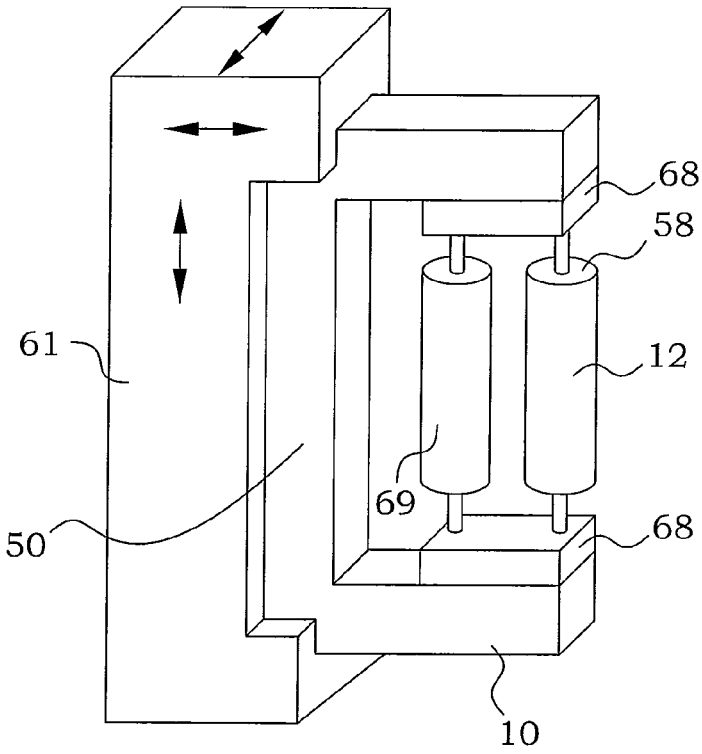

In FIG. 7B, another embodiment of a tool 10 for manufacturing of a mechanical element having a curved surface is illustrated. In this tool, only one tribochemical working surface 12 is present. The working surface 12 covers the cylindrical surface of a cylinder shaped tool holder 58, in turn supported by a support portion 50, in this embodiment having a general U-shape. The tool holder 58 is possible to rotate around its axis in order to present different parts of the surface in the front direction. The tool 10 in this embodiment is intended for treatment of an outer curved surface. The tool 10 is driven by a driving means 61 arranged to move the support portion 50 along a predetermined path. The elasticity of the support portion 50 and the tool holder 58 cooperates with the motion of the driving means 61 to create a force pressing the working surface 12 against the surface to be treated. The driving means 61 could easily be implemented by e.g. a CNC machine or an industrial robot.

In the present embodiment, a tribochemically inert stone 69 is additionally attached to the support portion 50. The attachment part of the support portion is arranged as a means 68 for exchanging positions of the tribochemical deposition tool working surface and the tribochemically inert stone. The support portion 50 thereby becomes usable for both tribochemical deposition and other possible tribochemically inert treatments, such as rough honing, roughing-up of the surface before deposition or post-deposition compacting of the tribochemical surface.

Figure 8:
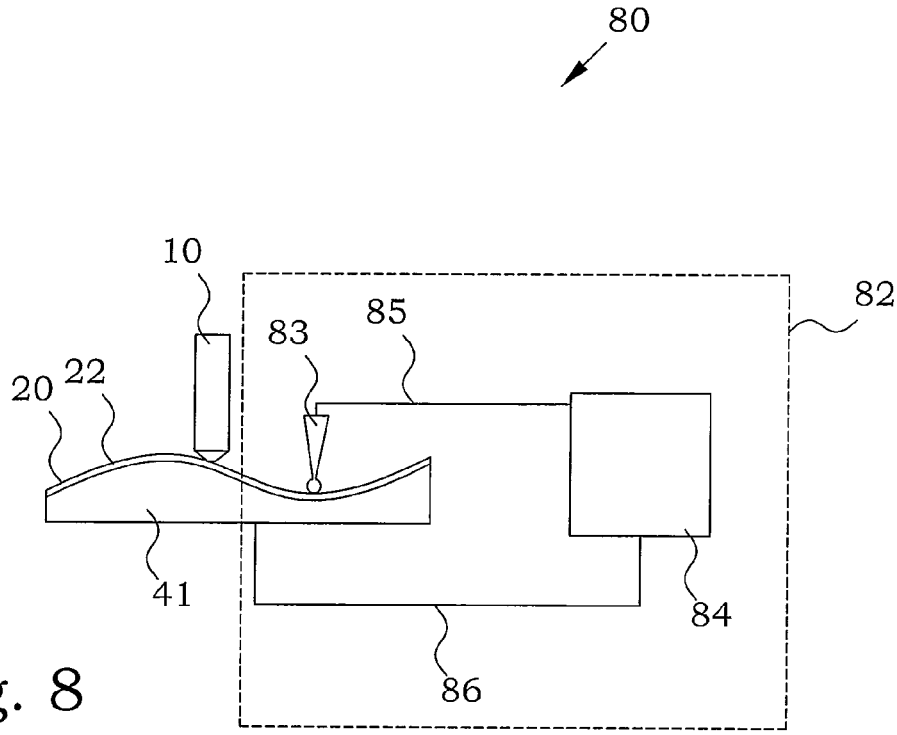
FIG. 8 illustrates an embodiment of an apparatus for manufacturing of a mechanical element having a curved surface.

An embodiment of an apparatus 80 for manufacturing of a mechanical element having a curved surface is illustrated in FIG. 8. A tool 10 is arranged to be pressed against and moved relative to a curved surface 20 of a mechanical element 41. A tribochemical surface layer 22 is thereby formed at the mechanical element 41. The apparatus 80 is in this embodiment provided with a contact resistance measuring means 82, comprising a control unit 84 electrically connected by connections 85, 86 to a measuring probe 83 and the mechanical element 41 respectively. The measuring probe 83 is a curved object with a radius smaller than the smallest radius of the curved surface of the mechanical element 41. The measurement probe 83 has a well defined surface and is brought into contact with the mechanical element in a well controlled manner. The control unit 84 is arranged to control the motion of the measuring probe 83. The control unit 84 is furthermore arranged to detect any changes in contact resistance. Such contact resistance measurement is known as such in prior art, but can applied in the present invention be used for controlling the working of the surface of the mechanical element 41 during the actual process. The contact resistance is largely influenced by the formation of the surface layer 22 and the working of the surface can thus be controlled until a requested contact resistance is achieved.

Figure 9A:
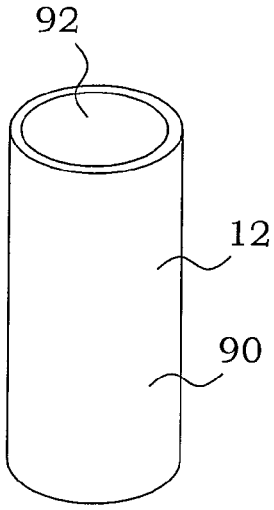
FIGS. 9A-D are embodiments of tool working surfaces.

The composition of the working surface of the tool has to provide the element capable of forming stable sulfides, e.g. a refractory metal, and in particular W and/or Mo, as a source for the tribochemical reaction. Suitable substances are to be found among oxides, carbides and silicides of these elements. Tool substances that are tested with good results are tungsten carbide, tungsten trioxide and molybdenum carbide. The working surface can be provided in different manners. A surface layer of the working surface substance can e.g. be deposited onto a tool core of another material, as e.g. indicated in FIG. 4. Such depositions can be provided by e.g. PVD processes. The crystal size of the particles on the tool surface should be kept small for increased reactivity. Preferably, a mean crystal size should be smaller than 100 nm. In FIG. 9A, an embodiment of a working stone usable with the present invention is illustrated. The working stone 90 comprises a cylindrical core 92. At the surface of the cylindrical core 92 a working surface 12 is deposited. The working stone 90 is during operation pressed against the surface to be treated and is simultaneously rotated. This has the advantage that the material of the working surface 12 will be worn at essentially the same rate all around the working stone 90.

The actual shape of the working surface 12 is preferably adapted to the surface it is intended to treat. Treatment by a point contact between the working surface and the surface to be covered is possible, at least in theory. However, for practical purposes, extended contact areas or line contacts are preferred. In the embodiment of FIG. 9A, the contact area is typically a line contact. The working surface can therefore have different geometrical shapes. If the surfaces to be covered have small concave structures, the geometrical extension of the working surface has to be small. Here, a conformal contact area may be to prefer. In such embodiments, the contact area is an extended surface created when two mating surfaces fit exactly or even closely together. If instead a convex surface is to be treated, larger, and even plane or concave working surfaces can be used. Also here conformal contact areas may be used. For plane surfaces to be covered, the working surface may also be plane. However, the total contact area has to be kept small enough to give a sufficient pressure in the contact zone. Line contacts are typically possible to use at all flat surfaces and surfaces being curved in one direction.

Figure 9B:
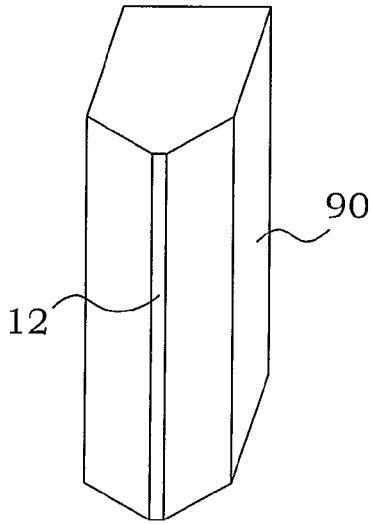

In FIG. 9B, another embodiment of a working stone 90 is illustrated. Here, the core 90 is covered by a working surface only at one narrow limited section. Such an embodiment has the advantage of being easy to attach to a tool, and no further motions have to be provided. As mentioned above, surfaces having small concave curvature radii may be treated. The disadvantage is instead that the material of the working surface is very limited and the working stone 90 of this embodiment will quickly be worn out.

Figure 9C:
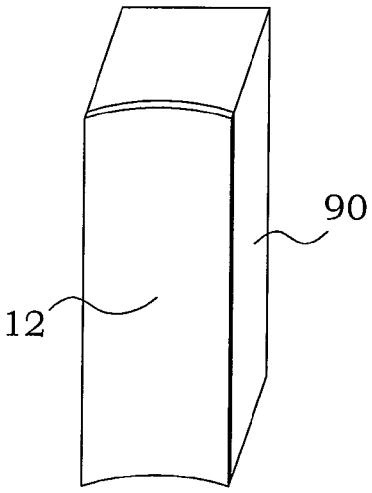

In FIG. 9C, yet another embodiment of a working stone 90 is illustrated. Here, the core 90 is provided with a concave surface, with a working surface 12 deposited thereon. Such a working stone 90 is suitable e.g. for treating the outer surface of a shaft.

Figure 9D:
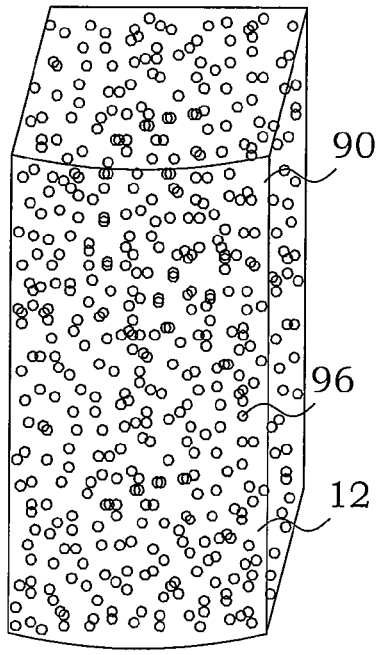

Another alternative is to provide a tool with a working stone, where the requested working surface substance exists throughout the entire volume of the working stone. Such an embodiment is schematically illustrated in FIG. 9D. In such a way, the life-time for a working surface of a tool can be increased considerably. Such a tool can be manufactured e.g. by binding grains of the oxide, carbide and/or silicide of Mo and/or W together by a binder substance. Suitable candidates can be found from metallic iron and carbon based synthetic adhesives. In the embodiment of FIG. 9D, the working stone 90 could also exhibit small porous volumes 96, distributed all over the working surface, containing small amounts of necessary sulfur substances. The provision of the necessary sulfur can thus be achieved without need for any external supply.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

The invention claimed is:

1. Manufacturing method for mechanical element, comprising the step of:

providing a mechanical element having a surface to be covered;

applying a sulfur-containing substance on said surface to be covered; and tribochemically depositing solid lubricant substance directly onto said surface to be covered on which the sulfur-containing substance has been applied while a tribochemical deposition tool working surface is pressed against said surface to be covered;

wherein said tribochemical depositing is performed by:

a) causing said tribochemical deposition tool working surface to slide in a first direction along said surface to be covered in each point of at least a part of said surface to be covered; and b) causing said tribochemical deposition working tool working surface to slide in a second direction, which is transverse to said first direction, along said surface to be covered, and wherein the first and second directions are non-parallel, and the paths along which the tribochemical deposition working tool is caused to move in a) and b) intersect in a point on the surface to be covered.

2. Method according to claim 1, wherein said step of tribochemically depositing comprises:

while pressing and sliding said tribochemical deposition tool working surface against said surface to be covered in said first and second directions, causing deformation in a contact zone between said tribochemical deposition tool working surface and said surface to be covered, and further causing wear transfer of material from said tribochemical deposition tool working surface to said surface to be covered, providing a smooth mechanical element surface.

3. Method according to claim 2, wherein said sulfur-containing substance is supplied to said contact zone during said pressing and sliding, such that sulfur reacts with said material being wear transferred.

4. Method according to claim 3, wherein said mechanical element at said surface to be covered comprises a substance being capable of forming a stable sulfide.

5. Method according to claim 4, wherein said substance being capable of forming a stable sulfide is Fe.

6. Method according to claim 1, wherein said surface to be covered is a rough surface having a surface roughness of more than $S_a$=0.1 μm, where $S_a$ is defined as a three-dimensional arithmetic average roughness, also known as the centre-line average roughness.

7. Method according to claim 1, wherein said solid lubricant substance comprises a sulfide of at least one of Mo and W.

8. Method according to claim 7, wherein said tool working surface comprises at least one of an oxide, carbide and silicide comprising at least one of Mo and W.

9. Method according to claim 8, wherein said tool working surface comprises a binder substance binding grains of said at least one of an oxide, carbide and silicide comprising at least one of Mo and W.

10. Method according to claim 1, wherein said surface to be covered is a curved surface.

11. Method according to claim 10, wherein said curved surface is a concave surface of a cylinder bore.

12. Method according to claim 11, wherein said curved surface is an outer convex surface.

* * * * *